US008813442B1

(12) United States Patent
Edwards et al.

(10) Patent No.: US 8,813,442 B1
(45) Date of Patent: Aug. 26, 2014

(54) SNAP-TOGETHER WINDOW FRAME

(71) Applicant: Weber Manufacturing Technologies Inc., Midland (CA)

(72) Inventors: Chris Garry Edwards, Midland (CA); Timothy Ryan Krokos, Tiny (CA); Kenneth Karl Kussen, Coldwater (CA); Edgar Grant Eckenswiller, Port McNicoll (CA)

(73) Assignee: Weber Manufacturing Technologies Inc., Midland, Ontario (CA)

( * ) Notice: Subject to any disclaimer, the term of this patent is extended or adjusted under 35 U.S.C. 154(b) by 32 days.

(21) Appl. No.: 13/836,055

(22) Filed: Mar. 15, 2013

(51) Int. Cl.

| | |
|---|---|
| ***E06B 1/60*** | (2006.01) |
| ***E06B 3/54*** | (2006.01) |
| ***E06B 1/36*** | (2006.01) |
| ***E06B 3/26*** | (2006.01) |
| *E06B 3/64* | (2006.01) |
| *E06B 1/56* | (2006.01) |
| *E06B 3/58* | (2006.01) |

(52) U.S. Cl.
CPC . *E06B 3/549* (2013.01); *E06B 1/36* (2013.01); *E06B 3/26* (2013.01); *E06B 3/64* (2013.01); *E06B 1/56* (2013.01); *E06B 3/58* (2013.01); *E06B 1/60* (2013.01)
USPC ..... 52/204.5; 52/204.62; 52/204.56; 52/213; 52/208; 52/585.1

(58) Field of Classification Search
CPC ..... E06B 1/60; E06B 1/56; E06B 3/549; E06B 3/58; E06B 3/5418; E06B 3/64; E06B 3/673; E06B 3/67326; E06B 5/00; E06B 5/003
USPC ..... 52/204.62, 204.64, 204.7, 204.5, 208, 52/204.56, 204.69, 213, 211, 585.1, 656.4, 52/656.5, 656.6
See application file for complete search history.

(56) References Cited

U.S. PATENT DOCUMENTS

| | | | | |
|---|---|---|---|---|
| 3,750,358 | A | 8/1973 | Lewkowitz | |
| 3,760,543 | A * | 9/1973 | McAllister | 52/204.591 |
| 4,246,731 | A | 1/1981 | Miro | |
| 4,428,546 | A | 1/1984 | Weideman | |
| 4,473,024 | A | 9/1984 | Armstrong | |
| 4,582,447 | A | 4/1986 | Itoh | |
| 4,702,429 | A | 10/1987 | Black | |
| 4,720,951 | A * | 1/1988 | Thorn et al. | 52/208 |
| 4,947,527 | A | 8/1990 | Hennig | |
| 5,098,322 | A | 3/1992 | Higby | |
| 5,249,403 | A * | 10/1993 | Neilly et al. | 52/204.5 |
| 5,369,922 | A | 12/1994 | Hansen | |
| 5,570,548 | A | 11/1996 | Hopper | |
| 5,634,508 | A * | 6/1997 | Herbst | 160/371 |
| 5,644,881 | A * | 7/1997 | Neilly | 52/455 |
| 6,272,801 | B1 | 8/2001 | Suh | |

(Continued)

*Primary Examiner* — Phi A
(74) *Attorney, Agent, or Firm* — Riches, McKenzie & Herbert LLP

(57) ABSTRACT

A window frame assembly to secure a glass pane within a window opening in a door slab. The assembly preferably includes two identical frame halves carrying bosses on which modular clip members are secure. The clip members each carry a male post member and a female socket member. Each clip member on a half frame engages a corresponding clip member on the other half frame with their female and male socket members engaging the outer surface of the clip member carrying a key member complementary to the keying member.

19 Claims, 12 Drawing Sheets

(56) References Cited

U.S. PATENT DOCUMENTS

| | | | | |
|---|---|---|---|---|
| 6,574,935 | B2 | 6/2003 | Wang Chen | |
| 6,925,767 | B2 | 8/2005 | Krochmal et al. | |
| 7,010,888 | B2 * | 3/2006 | Tumlin et al. | 52/204.56 |
| 7,107,736 | B2 | 9/2006 | Barnard | |
| 7,430,836 | B2 | 10/2008 | Sibbett | |
| 7,448,174 | B2 | 11/2008 | Krochmal et al. | |
| 7,490,442 | B1 | 2/2009 | Jackson et al. | |
| 7,757,365 | B2 | 7/2010 | Ouellette | |
| 7,971,623 | B2 | 7/2011 | Barnard et al. | |
| 8,707,639 | B2 * | 4/2014 | Thompson | 52/204.7 |
| 2004/0123536 | A1 * | 7/2004 | Lee | 52/208 |
| 2005/0016091 | A1 * | 1/2005 | Chen | 52/204.1 |
| 2010/0251635 | A1 * | 10/2010 | Barnard et al. | 52/127.6 |

* cited by examiner

SNAP-TOGETHER WINDOW FRAME

SCOPE OF THE INVENTION

This invention relates to frames and, more particularly, to window frames which seal against door surfaces as to retain a thin panel such as a glass pane within an opening in a door.

BACKGROUND OF THE INVENTION

Openings are known to be provided through walls and doors within which windows are provided. For example, in garage doors and exterior doors, a window opening is generally cut or pre-formed through the door where a window is desired. Insertion of a glass window pane into the window openings often involves providing an interior half frame and an exterior half frame which are secured to each side of the door with horizontally extending screws retaining the glass pane for the window between the half frames within the window opening.

Known such systems for securing glass panes in window openings of doors suffer a number of disadvantages including requiring difficult and expensive installation by reason of use of the screws and providing unsightly appearances due to the visibility of heads of the screws.

SUMMARY OF THE INVENTION

To at least partially overcome these disadvantages of previously known devices, the present invention provides a window frame system in which opposed half frames are secured together without the use of threaded fasteners.

The present invention in one aspect provides a window frame assembly to secure a glass pane within a window opening in a door slab. The assembly preferably includes two identical frame halves carrying bosses on which modular clip members are secure. The clip members each carry a male post member and a female socket member. Each clip member on a half frame engages a corresponding clip member on the other half frame with their female and male socket members engaging the outer surface of the clip member carrying a key member complementary to the keying member.

In one aspect, the present invention provides a window frame comprising:

a first frame half comprising an elongate first frame member, a second frame half comprising an elongate second frame member, each frame member having an inner surface and an outer surface, each frame member having an elongate inwardly directed first clamp surface extending along a first lateral edge of the inner surface adapted for engagement with a first panel and an elongate inwardly directed second clamp surface extending along a second lateral edge of the inner surface adapted for engagement with a second panel, the frame members removable coupled together with:

(a) the inner surfaces in opposition to each other, (b) the inner clamp surface of each frame member spaced a first distance apart from the inner clamp surface of the other frame member and extending parallel to the inner clamp surface of the other frame member, and (c) the outer clamp surface of each frame member spaced a second distance apart from the outer clamp surface of the other frame member and extending parallel to the outer clamp surface of the other frame member, each of the first frame half and the second frame half having on their inner surfaces a plurality of identical locating bosses, the bosses evenly spaced longitudinally along the frame members, each locating boss carrying a keying member, a plurality of identical modular clip members, each clip member having an inner surface and an outer surface, the outer surface of the clip member including a key member complementary to the keying member, each clip member fixedly secured to a respective one of the locating bosses with the keying member engaging the key member to locate the clip member in the orientated position, the outer surface of each clip member carrying a female socket member and a male post member, the first frame member secured to the second frame member by each clip member on each locating boss on the first frame member being coupled to a respective clip member secured to a locating boss on the second frame member to form a paired connection in which the outer surface of each clip member of each paired connection in is opposition to the outer surface of each other clip member of each paired connection with the male post member of each clip member of each paired connection frictionally received in frictional engagement in the female socket member of each other clip member of each paired connection.

In another aspect, the present invention provides a window frame comprising:

a first frame half comprising an elongate first frame member, a second frame half comprising an elongate second frame member, each frame member having an inner surface and an outer surface, each frame member having an elongate inwardly directed first clamp surface extending along a first lateral edge of the inner surface adapted for engagement with a first panel and an elongate inwardly directed second clamp surface extending along a second lateral edge of the inner surface adapted for engagement with a second panel, each of the first frame half and the second frame half having on their inner surfaces a plurality of identical locating bosses, the bosses evenly spaced longitudinally along the frame members, each locating boss carrying a keying member, a plurality of identical modular clip members, each clip member having an inner surface and an outer surface, the outer surface of the clip member including a key member complementary to the keying member, each clip member fixedly secured to a respective one of the locating bosses with the keying member engaging the key member to locate the clip member in an orientated position, the outer surface of each clip member carrying a female socket member and a male post member, the first frame member secured to the second frame member by each clip member on each locating boss on the first frame member being coupled to a respective clip member secured to a locating boss on the second frame member to form a paired connection in which the outer surface of each clip member of each paired connection in is opposition to the outer surface of each other clip member of each paired connection with the male post member of each clip member of each paired connection frictionally received in frictional engagement in the female socket member of each other clip member of each paired connection.

BRIEF DESCRIPTION OF THE DRAWINGS

Further aspects and advantages of the present invention will become apparent from the following description together with the drawings in which.

DETAILED DESCRIPTION OF THE DRAWINGS

Figure 1:
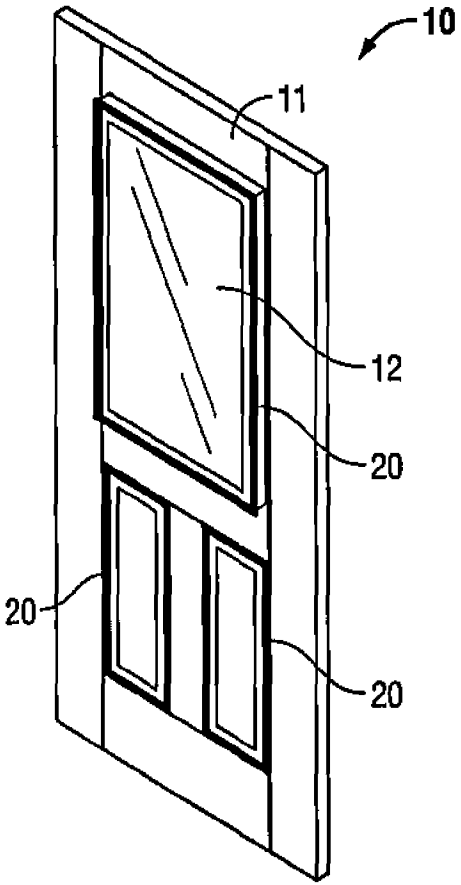
FIG. 1 is a perspective view of an entry door having panels secured thereto in accordance with a window framing system of the present invention.

FIG. 1 shows an entrance door 10 having a door slab 11 with a plurality of recessed panels 12 secured to the door slab 11 by half frames 20.

Figure 2:
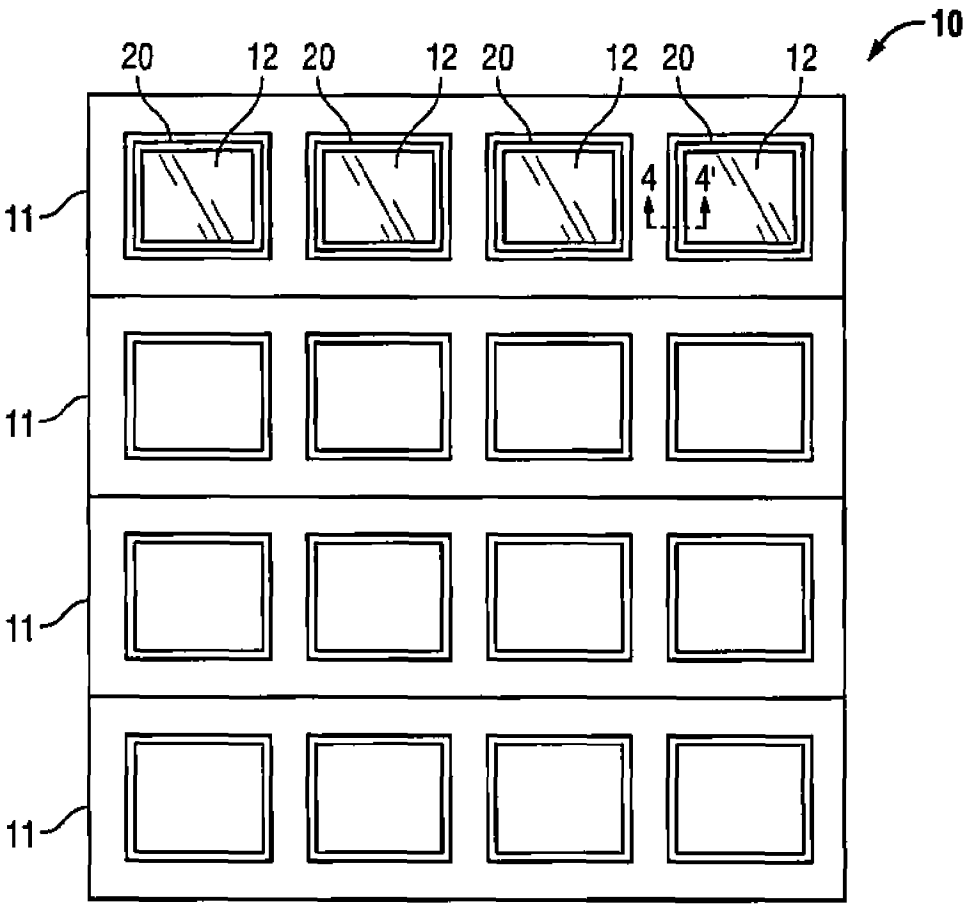
FIG. 2 is a front view of a garage door including glass window panes secured to the door in accordance with the window framing system of the present invention.

FIG. 2 is a front view of a garage door 10 formed of four horizontally extending door slabs 11. A series of recessed panels 12 are coupled to each door slab 11 by half frames 20. In each of the doors 10 in FIGS. 1 and 2, the uppermost recessed panels 12 comprise a pane of glass or plastic.

Figure 3:
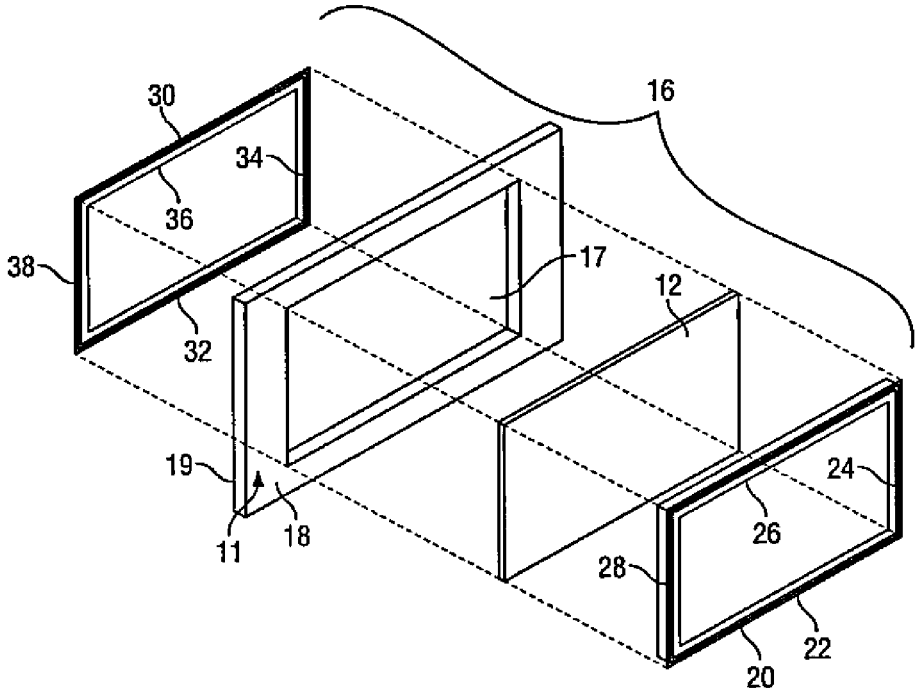
FIG. 3 is an exploded, schematic partial pictorial view of the door slab of the upper panel of the garage door shown in FIG. 2 showing the upper right hand window opening, the window pane and the two half frame members.

Reference is made to FIG. 3 which is a schematic illustration of the upper right hand portion of the garage door 10 of FIG. 2 showing the construction of a window 16. As seen in FIG. 3, the door slab 11 has a rectangular window opening 17 formed therethrough. A rectangular glass window panel 12 is sized to fit within the opening 17. An exterior outer half frame 20 is provided on the outer side 18 of the door slab 11 and an inner half frame 30 is provided on the inner side 19 of the door slab 11. In FIG. 3, each of the outer half frame 20 and inner half frame 30 are only schematically shown and the particular elements used to couple the two half frames together are not shown.

The outer half frame 20 is formed from four elongate first frame members 22, 24, 26 and 28 joined together at their ends to form the rectangular outer half frame 20. The inner half frame 30 is similarly formed from four elongate second frame members 32, 34, 36 and 38 also joined together to form a rectangle which is of identical dimensions to the rectangle of the outer half frame 20.

Figure 19:
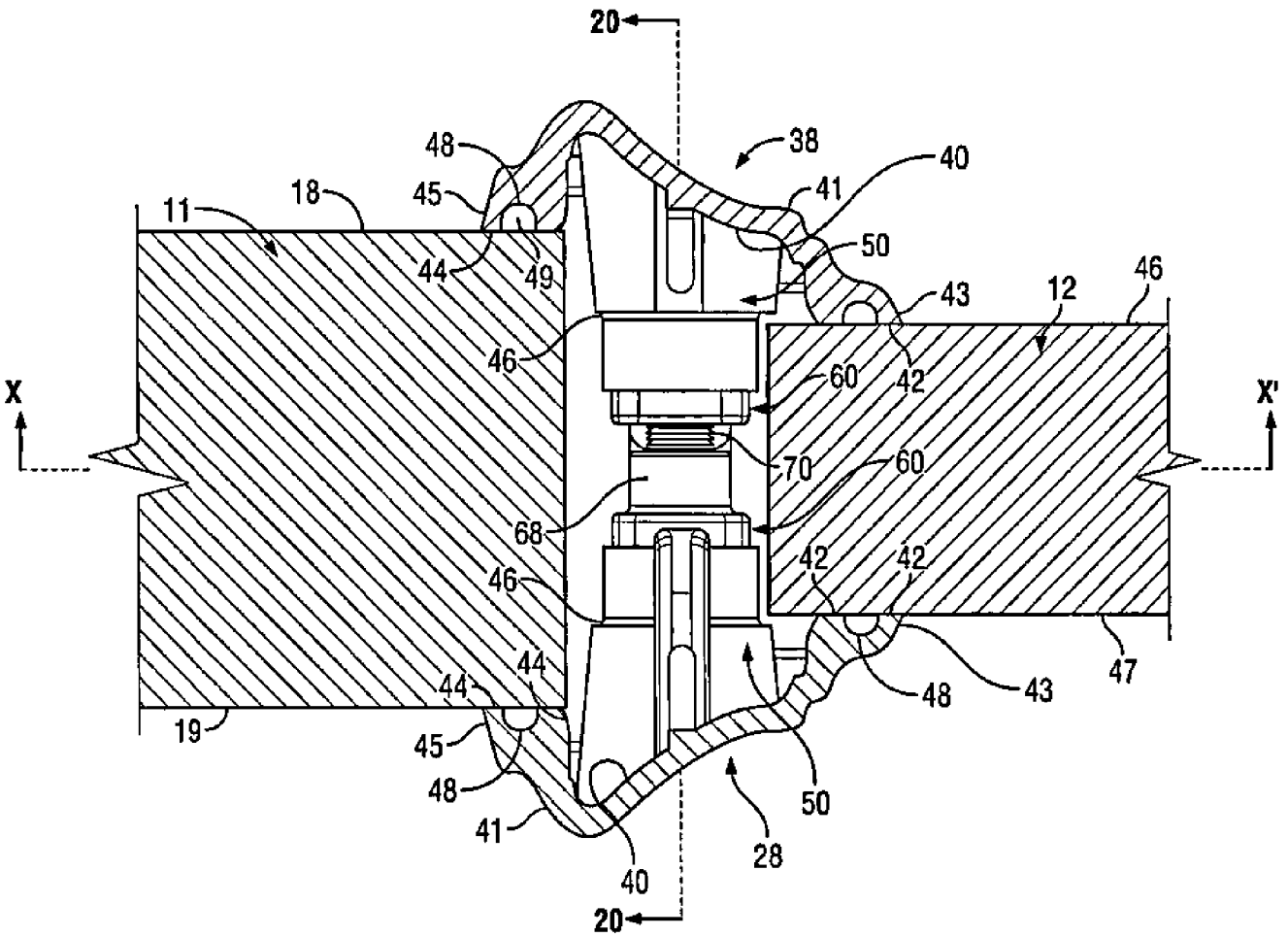
FIG. 19 is an end view of the window frame structure shown in FIG. 17.

Reference is made to FIG. 19 showing a cross-sectional view of the door slab 11 and the window panel 12 in FIG. 2 along section line 4-4' and showing each of the first frame member 28 and second frame member 38 in cross-section. As can be seen, each of these frame members has an inner surface 40 and outer surface 41. The inner surfaces 40 and the outer surfaces 41 of the first frame member 28 and the second frame member 38 are mirror images of each other along a door center plane X-X' in FIG. 19. Each of the frame members 28 and 38 is elongated extending along a longitudinal and has a first lateral edge 43 and a second lateral edge 45 at the junction of the inner surface 40 and the outer surface 41 as seen in FIG. 19. The first lateral edge 43 and the second lateral edge are parallel to each other and to a longitudinal of each frame member. The inner surface 40 of each frame member includes an elongate inwardly directed first clamp surface 42 which extends along the first lateral edge 43 for clamping engagement with the window panel 12. The inner surface 40 of each frame member includes an elongate inwardly directed second clamp surface 44 extending along the second lateral edge 45 for clamping engagement with the door slab 11.

A coupling mechanism 46 is provided on the inner surface 40 of each of the frame member to couple the frame members together. In a coupled arrangement 46 as illustrated, for example in FIG. 19, the frame members 28 and 38 are removably coupled together with (a) the inner surface 40 of the frame member 28 in opposition to the inner surface 40 of the other opposite frame member 38, (b) the inner clamp surface 42 of the frame member 28 spaced a first distance D1 apart from the inner clamp surface of the other frame member 38 and extending parallel to the inner clamp surface 42 of the other frame member 38, and (c) the outer clamp surface 44 of the frame member 28 spaced a second distance D2 apart from the outer clamp surface 44 of the other frame member 38 and extending parallel to the outer clamp surface 44 of the other frame member 38. In FIG. 19, the distance D1 is equal to the thickness of the window panel 12 and a distance D2 is equal to the thickness of the door slab 11. As can be seen, the first clamp surface 42 of the frame member 28 engages an outer surface 46 of the window panel 12 and the first clamp surface 42 of the inner frame member 38 engages an inner surface 47 of the window panel 12. Similarly, the second clamp surface 44 of the outer frame member 28 engages the outer side 18 of the door slab 11 and the second clamp surface 44 of the inner frame member 38 engages the inner side 19 of the door slab 11. A slotway 48 is provided extending inwardly from the first clamp surface 42 within which a resilient gasket member 49 is provided to be compressed between the bracket member 28 and the outer side 18 of the door slab 11 to provide an improved seal. Similar such slots 48 are provided in the other first clamp surface 42 and the two second clamp surfaces 44, however, for ease of illustration, gaskets are not shown in these other slots.

Figure 4:
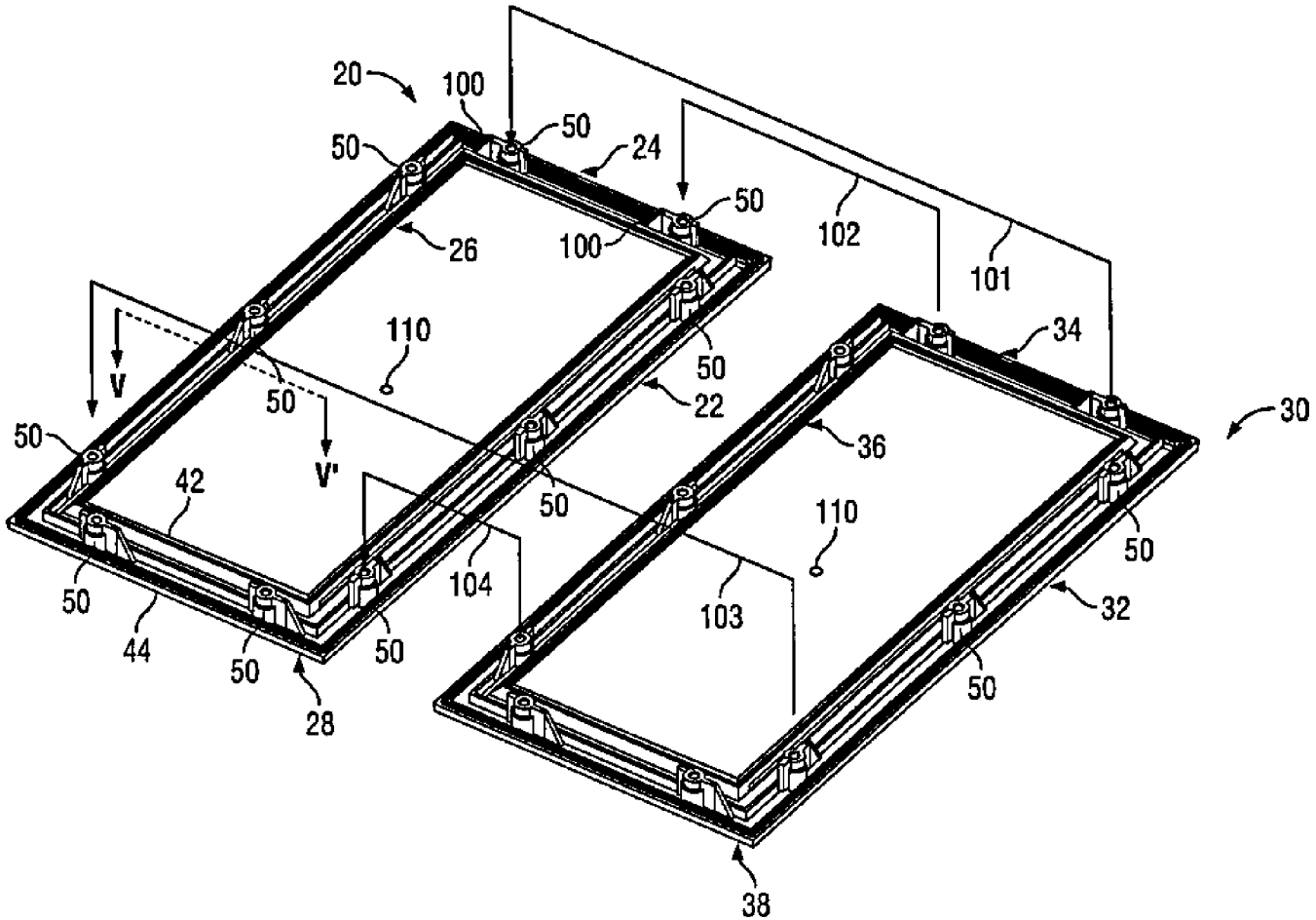
FIG. 4 is a top perspective view of the two half frames showing details of their interior surfaces.
Figure 5:
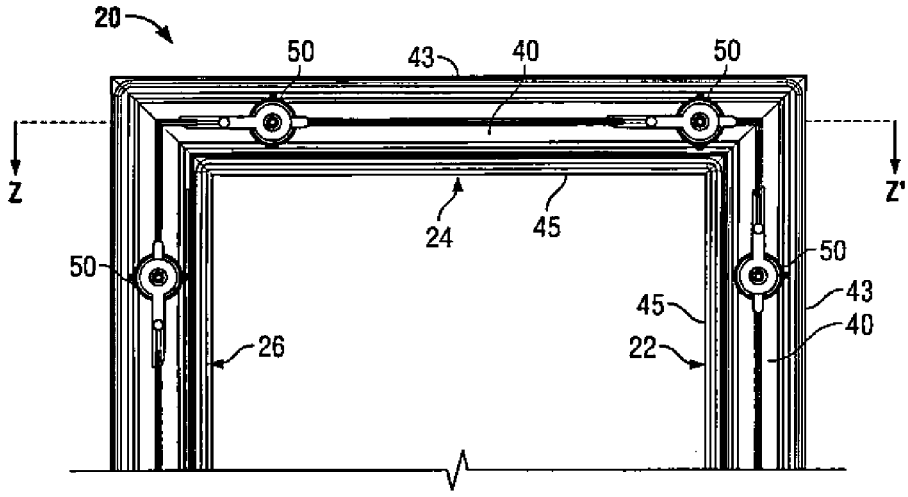
FIG. 5 is an enlarged top view of a section of the half frame shown in FIG. 4.
Figure 6:
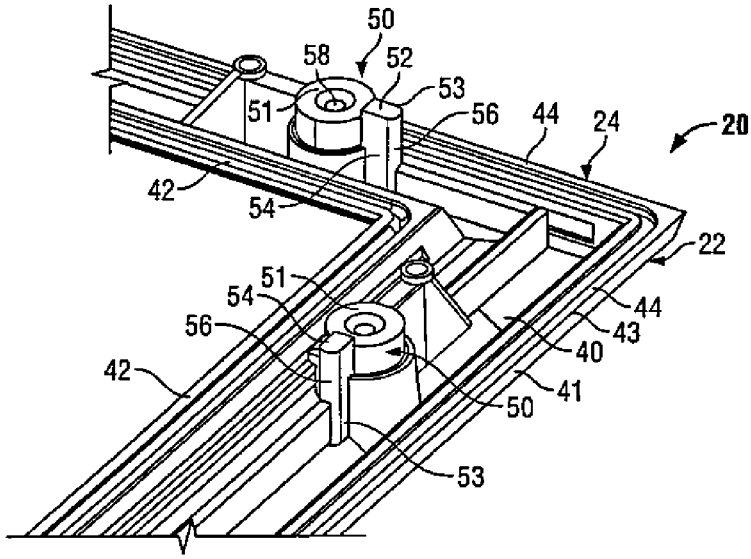
FIG. 6 is an enlarged pictorial view of the upper right corner of the half frame shown in FIG. 4.
Figure 7:
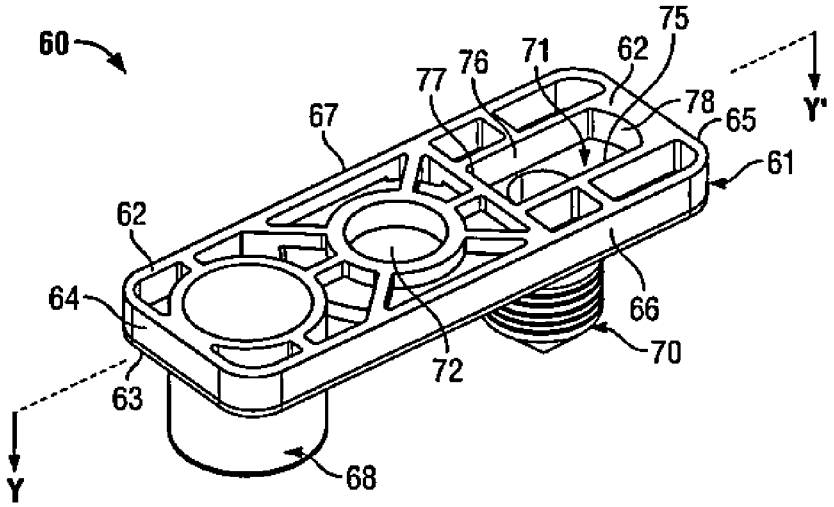
FIG. 7 is a bottom pictorial view of a clip member in accordance with the invention.
Figure 8:
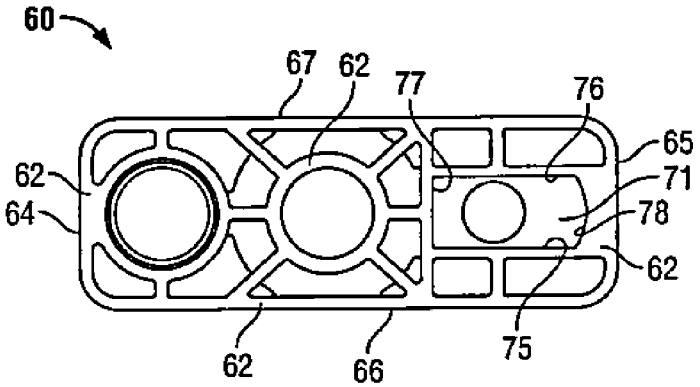
FIG. 8 is a bottom view of the clip member of FIG. 7.
Figure 9:
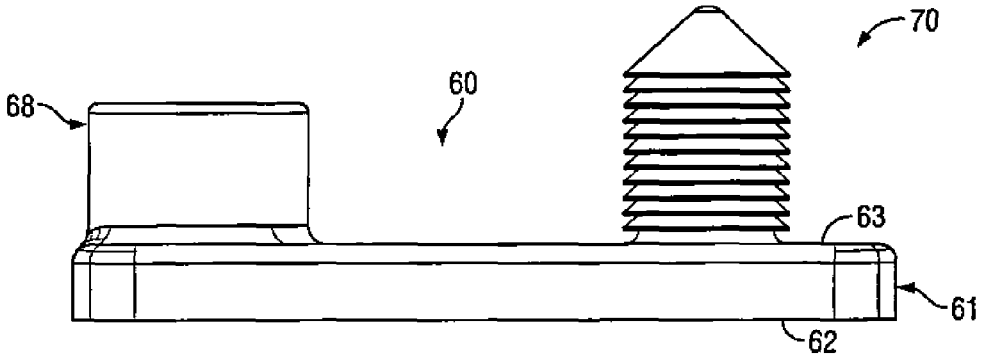
FIG. 9 is a front view of the clip of FIG. 7.
Figure 10:
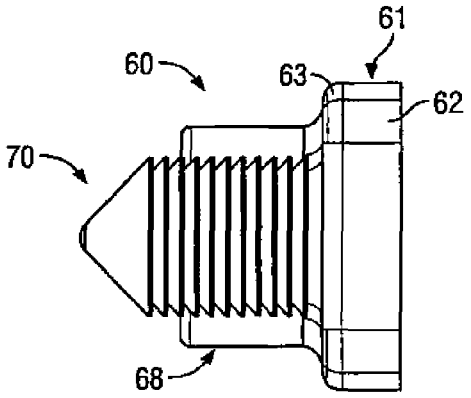
FIG. 10 is a right end view of the clip member of FIG. 7.
Figure 11:
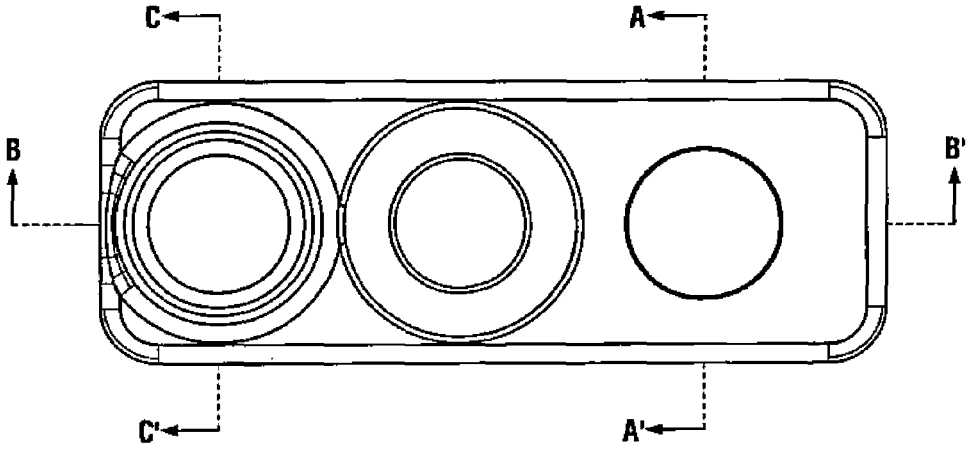
FIG. 11 is a top view of the frame clip in FIG. 10.
Figure 20:
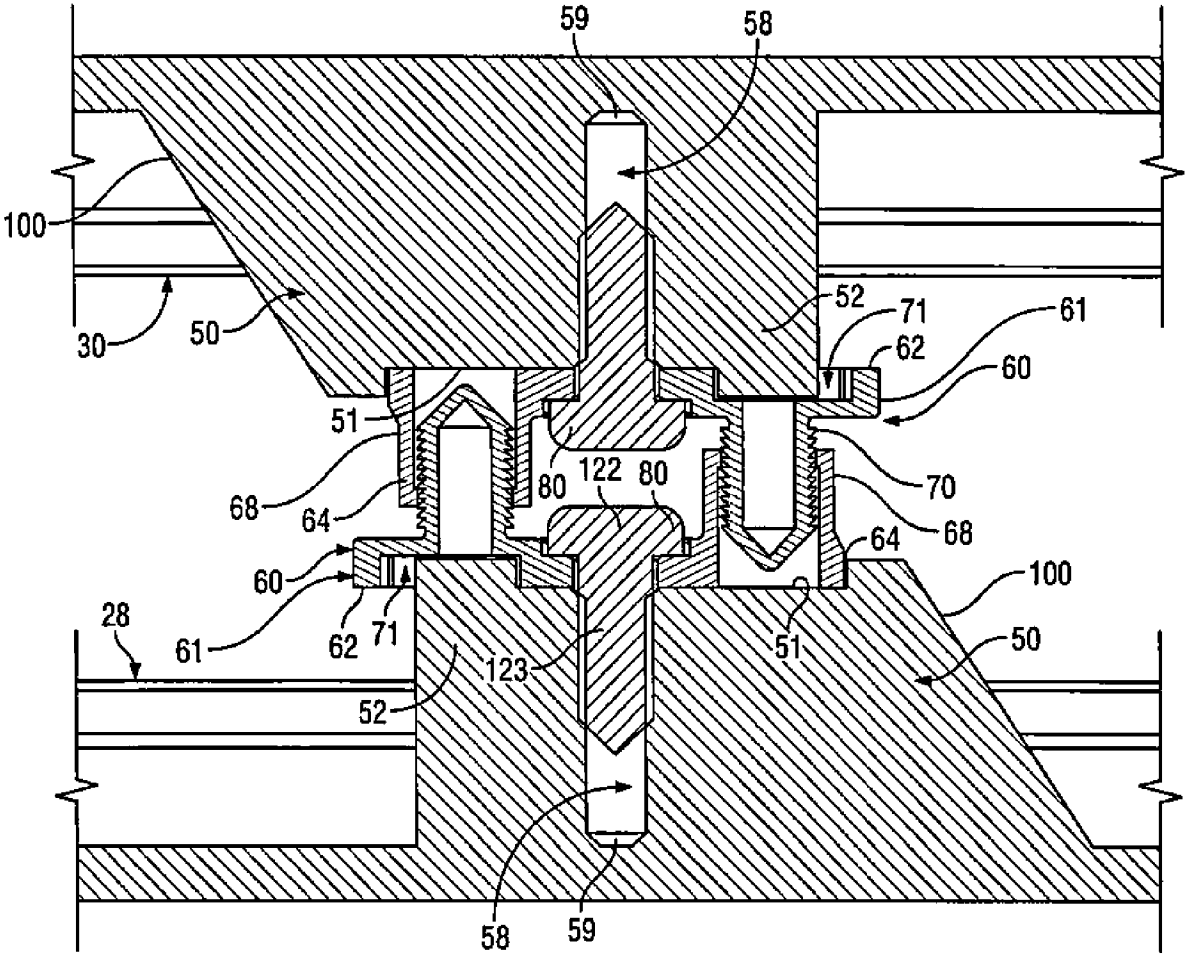
FIG. 20 is a cross-sectional side view along section line D-D' in FIG. 19.

Reference is made to FIG. 4 which is a pictorial view of the outer half frame 20 and the inner half frame 30 showing the inner surface 40 of each of their frame members. On the interior surface 40 between the first clamp surface 42 and the second clamp surface 44, a plurality of locating bosses 50 are provided spaced longitudinally from each other on each of the frame members. As best seen in FIGS. 5 and 6, each locating boss 50 provides a planar support surface 51. The support surfaces 51 on each of the location bosses 50 are disposed in a common plane which is parallel to a plane containing the first clamp surfaces 42. Each locating boss 50 also carries a keying lug member 52 which extends inwardly farther than the support surface 51. The keying lug member has a flat outer side surface 53 and the flat inner side surface 54 is disposed parallel to the outer side surface 53. Side surfaces 53 and 54 end at a first end surface 55 which extends between the side surfaces 53 and 54 normal to the side surfaces 53 and 54. The side surfaces 53 and 54 end at a second rounded end surface 56. The end surface 55 extends downwardly on the keying lug member 52 to the support surface 51. A blind bore 58 extends from the support surface 51 into the locating boss 50 normal to the support surface 51 to a blind inner end 59 as seen in FIG. 20. Each locating lug 50 extends along a longitudinal indicated as Z-Z' in FIG. 5, which is parallel to each side edge 43 and 45 of each frame member.

Reference is made to FIGS. 7 to 14 which illustrate a modular clip member 60. One clip member 60 is to be secured to each of the bosses 50. The clip member 60 comprises a generally rectangular base 61 with an outer surface 62 and an inner surface 63 joined by a male end 64, a female end 65, a first side 66 and a second side 67.

The clip member 60 has a socket-forming female member 68 extending inwardly from the inner surface 63 proximate the female end 64. The clip member 60 has a post-forming male member 70 extending inwardly from the inner surface 63 proximate the male end 65. A central opening 72 extends through the base 61 between the outer surface 62 and the inner surface 63. The outer surface 62 has formed therein a key recess 71 with a first side locating surface 75 and a second side locating surface 76. The side locating surfaces 75 and 76 are disposed parallel to each other and parallel to a central longitudinal of the clip member indicated as Y-Y' extending through the base 61. The key recess 71 has an inner end surface 77 proximate to the opening 72 and an outer end surface 78 proximate to the male end 65. The key recess 71 is sized so as to receive a keying lug member 52 on a locating boss 50 with side locating surfaces 75 and 76 of the key recess 71 to engage the flat side surfaces 53 and 54 on the keying lug member 52 to orient the longitudinal of the clip member 60 aligned with the longitudinal of the locating boss 50 and thereby with its respective frame member. The outer surface 62 of the clip member 60 is disposed in a flat plane. The outer surface 62 of the clip member 60 is adapted to engage and to be supported on the support surface 51 of a locating boss 50 with the circular opening 72 of the clip member 60 coaxially aligned with the bore 58 of the boss 50 permitting a fastener 80 to extend through the clip member 60 to secure the clip member 60 to a boss 50 as, for example, illustrated in each of FIGS. 15 to 20. As can be best seen in the vertical cross-section of FIG. 20, each clip member 60 is secured to a respective boss 50 with the outer surface 62 of the clip member 60 supported on the support surface 51 of the boss 50 and with the keying lug member 52 of the boss 50 received in the key recess 71 of the clip member 60 to longitudinally align the clip member 60 relative to the boss 50. The fastener 80 extends coaxially through the opening 72 and into the bore 58 so as to coaxially locate the opening 72 of the clip member 60 with the bore 58 of the boss 50.

Figure 12:
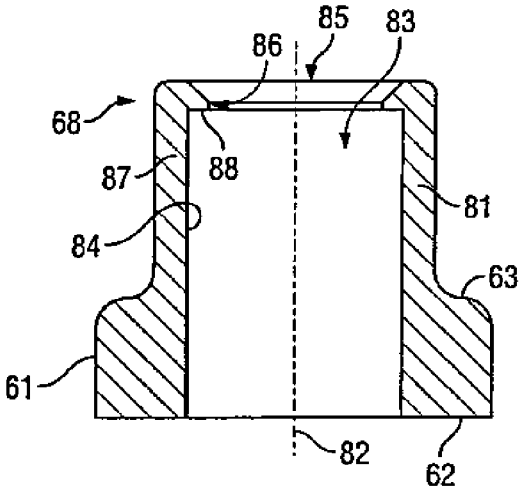
FIG. 12 is a cross-sectional end view along section line A-A' in FIG. 11.
Figure 14:
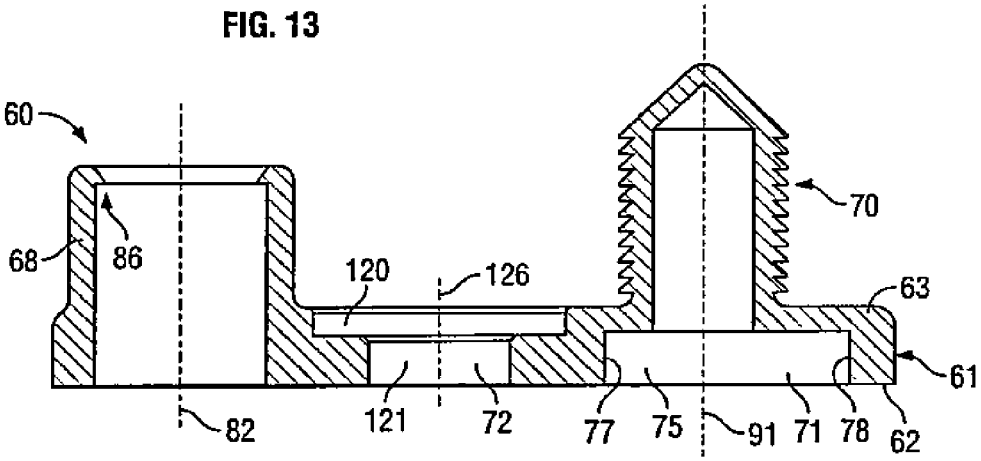
FIG. 14 is a cross-sectional side view along section line C-C' in FIG. 11.
Figure 15:
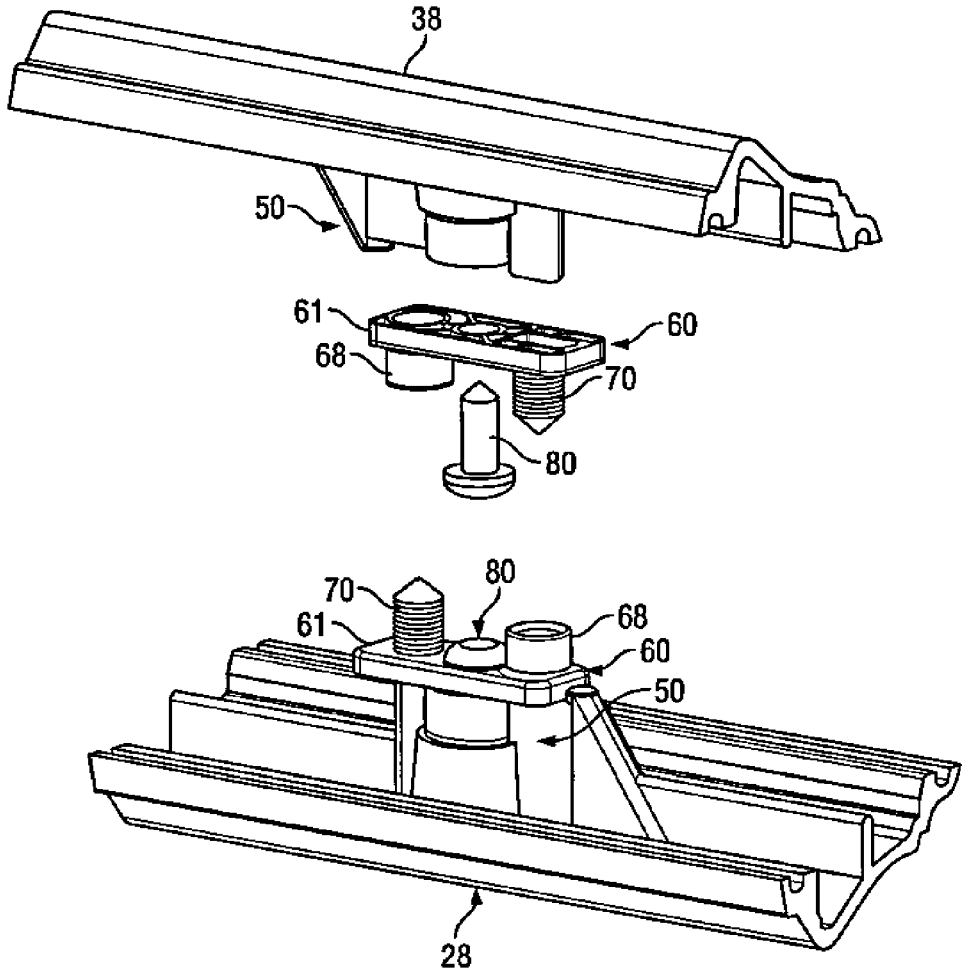
FIG. 15 is a schematic partially exploded pictorial view of a window frame structure showing short lengths of two opposed frame members of each half frame shown in FIG. 4 cross-sectioned at their ends and a pair of opposing clip members shown in FIG. 7 in relation to the pair of frame members.

As seen in FIGS. 12 and 14, the socket-forming female member 68 comprises a cylindrical tube 81 which extends inwardly from the inner surface 63 disposed about an axis 82 which is perpendicular to the outer surface 62 and passes through the longitudinal center line C-C' of the fastener clip 60. A socket 83 is formed within the tube 81 with the socket having a cylindrical inner surface 84. The socket 83 is open inwardly at an entry opening 85. Proximate the entry opening 85, an annular radially inwardly extending hook member 86 is provided to extend radially inwardly relative to the surface 84. The hook member 86 has an annular bevelled cam surface 87 which is disposed at an angle to extend axially inwardly away from the base 61 as it extends radially inwardly. The hook member 86 has annular catch shoulder 88 disposed in a plane substantially normal to the axis 82.

Figure 13:
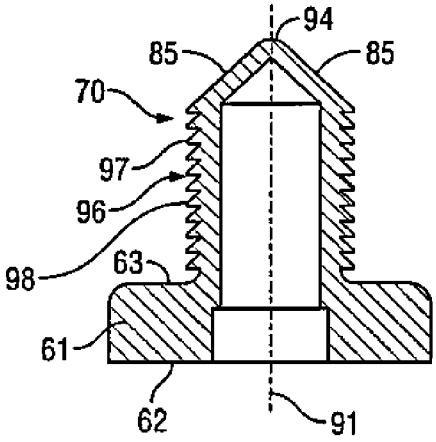
FIG. 13 is a cross-sectional end view along section line B-B' in FIG. 11.

The post-forming male member 70 as seen in cross-section in FIGS. 13 and 14 as coaxial about an axis 91 which is parallel to the axis 82 of the female member 68 and also intersects with the longitudinal center line C-C' of the clip member 60. The male member 70 extends about its axis 91 normal to the plane of the outer surface 62 of the base 61. The male member 70 has a generally cylindrical ribbed portion 92 and a head portion 93. The head portion 93 is frustoconical tapering from the ribbed portion 92 to a central apex 94 and providing entry camming surfaces 85 circumferentially about the head portion 83. The ribbed portion 92 carries a number of axially spaced disk-like annular catch members 96. Each catch member 96 includes an annular cam surface 97 on the side of each catch rib 96 away from the base 61 which cam surface 97 extends axially inwardly toward the base 61 as it extends radially outwardly. Each catch member 96 includes an annular catch shoulder 98 which is disposed in a plane generally perpendicular to the male axis 91.

Each modular clip member 60 is adapted to couple with an identical modular clip member 60 in a manner as illustrated in FIGS. 15 to 20 with male member 70 of each clip member 60 to be received in the female member 68 of the other clip member 60. Thus, as seen in each of FIGS. 17 to 20 and notably in FIG. 20, two clip members 60 are shown as coupled together with the male member 70 of the upper clip 60 received in the female member 68 of the lower clip 60, and the male member 70 of the lower clip member 60 received in the female member 68 of the upper clip 60. The male member 70 is adapted to coaxially slide into the socket 83 of the female member 68. Engagement of the caroming surfaces 85 of the head portion 83 of the male member 70 assists during initial insertion of coaxial alignment of the male member 70 and the female member 68. By applying forces which urges the male member 70 coaxially into the female member 68, one of the annular catch members 96 on the male member engage the annular hook member 86 on the female member 68. Engagement between the cam surfaces 87 and 97 of each that provides for relative radial deflection of one or both of the hook member 86 and the catch members 96 permitting the annular catch members 96 to successively be forced past the hook member 86. Withdrawal of the male member 70 from the female member 68 is substantially is prevented by engagement between the catch shoulder 88 of the female member 68 and the catch shoulder of one of the annular catch members 96 of the male member 70. With sufficient force applied to the male member 70 to urge it coaxially into the female member 68, the male member 70 moves into the socket 83 in a ratcheting-type manner as successive of the annular catch members 96 on the male member 70 are moved past the hook member 86.

In accordance with the present invention, each half frame 20 and 30 as shown in FIGS. 4 to 6 is preferably manufactured by molding as from fibreglass. One clip member 60 is secured to each locating boss 50 on each of the two half frame members 20 and 30. Each clip member 60 is secured to its respective boss 50 in an appropriate orientation on the boss by reason of each keying lug member 52 being received within the key recess 71 of the clip member 60 and the fastener 80 extending coaxially through the opening 72 of the clip member 60 into the bore 58 of the boss 50 so as to urge the flat outer surface 62 of the clip member 60 into engagement with the flat surface 51 on the boss 50. Subsequently, with a clip member 60 secured to each of the boss 50 in the correct longitudinal orientation, the two half frames 20 and 30 are then placed into opposition, one on either side of the door slab 11 about the window opening 17 with the window panel 12 in the window opening between the frame halves. Each clip member 60 carried on a boss 50 on the half frame 20 is aligned with an opposed clip member 60 on the half frame 30 with each clip member 60 having its male member 70 engage into a female member 68 of the opposed clip member 60. The half frames 20 and 30 are forcibly pushed together to force the male member 70 into the female member 68 frictionally engaging each of the door slab 11 and the window panel 12 between the frame halves.

Each of the half frames 20 and 30 is preferably identical as seen in FIG. 4 with the bosses 50 longitudinally orientated thereon such that when the two half frame members 20 and 30 are placed in opposition, as schematically indicated by the travel lines 101, 102, 104 and 104 showing the relative movement of the frame half 30 so as to overlie and align above the frame half 20, the bosses 50 carrying the clip members 60 to be suitably longitudinally orientated that for each clip member 60 there is an opposing clip member 60 whose male member 70 is adapted to engage into the female member 68. In FIG. 4, the two half frames 20 and 30 are identical and the bosses 50 on each frame member are to be disposed symmetrically relative a mid-point centered along the longitudinal of each frame. For example, on frame member 28, a mid-point is the bosses center line W-W' and the two bosses 50 on the frame member 28 are equally spaced relative this center line. Similarly, on frame member 26, the three bosses 50 are symmetrically located about a center line V-V'. For ease of use, the frame member 24 has bosses 50 identically spaced as on frame member 26 and the frame member 28 has bosses 50 identically spaced as on frame member 26. Either frame half can be rotated 180° and still be compatible with the other frame half. As seen in FIG. 4, each boss 50 with its angled end 100 directed in the same direction about a central point 110 of the half frame, counterclockwise about the center point 110 as seen in FIG. 4.

Each locating boss 50 is directional in the sense that it has locating lug 52 at one male end and an angled female end 100 at the other end. A clip member 60 coupled to the locating member 50 is longitudinally oriented directionally with the locating boss 50 with the male end 65 proximate the lug 52 and the female end 68 proximate the angled female end 100 of the locating boss 50. Each locating boss is disposed aligned with the longitudinal of its respective frame member and suitably directionally oriented such that it as indicated in FIG. 4 when the two frame halves are inverted and placed in opposition with each other, each boss 50 is directionally orientated such that the clip member 60 which it carries is directionally opposite to the clip member 60 with which it is to couple.

As seen in FIGS. 14 and 20, the circular opening 72 through the clip member 60 includes an inner portion 120 of larger diameter than an outer portion 121. As seen in FIG. 20, the fastener 8 has an enlarged head 122 and a shank 123 with the head 122 sized to be received within the inner portion 120 and the shank sized to be received within the outer portion 121.

Figure 16:
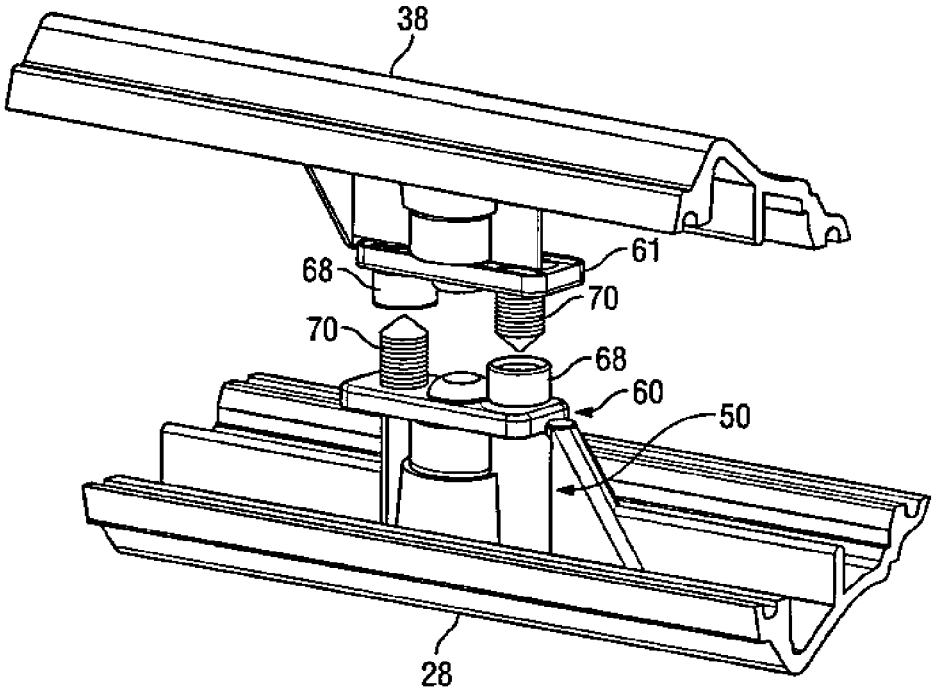
FIG. 16 is a view the same as FIG. 15 but showing both clip members secured to their respective frame members.
Figure 17:
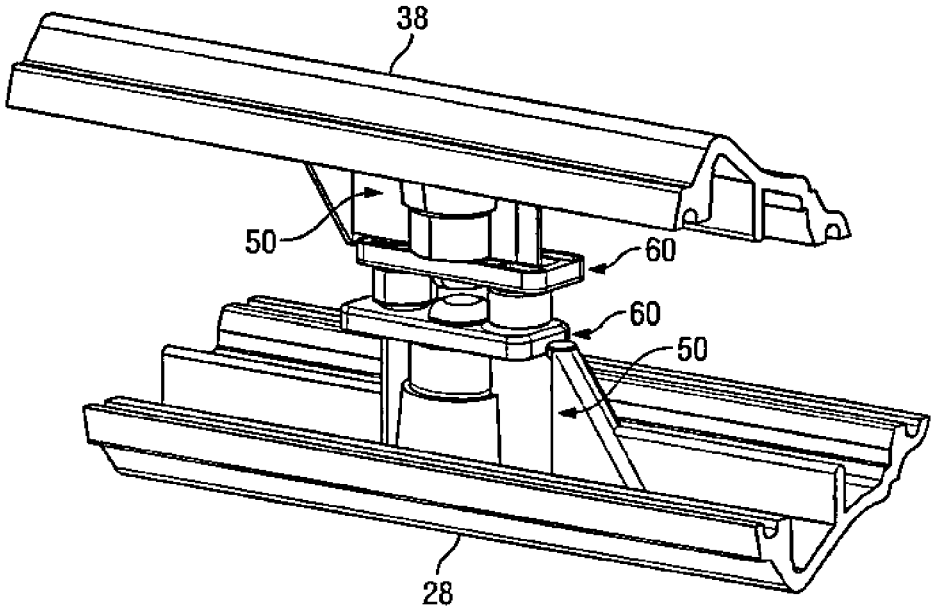
FIG. 17 is a view the same as FIG. 16 but showing each clip member coupled to the other clip member.
Figure 18:
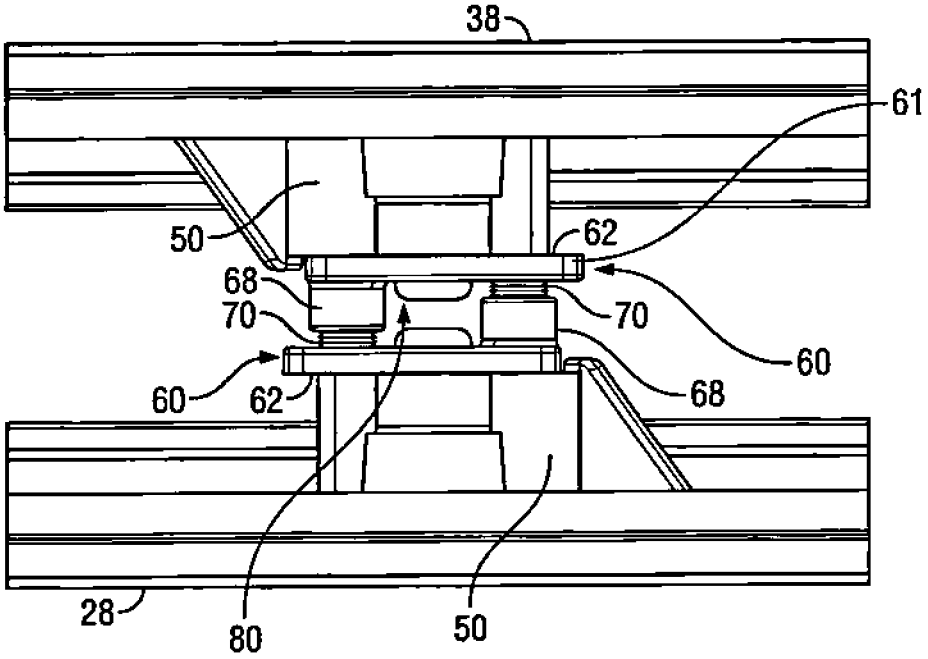
FIG. 18 is a side view of the window frame structure as shown in FIG. 17.

Preferably, each clip member 60 is securely fastened to its respective locating boss 50 with the outer surface 62 of the clip member securely forced into the support surface 51 of the locating boss 50, however, with some ability for the mounting clip 60 to slide relative to the locating lug 50 on the support surface 51, longitudinally and laterally side to side. Such minor movement facilitates the coaxial alignment of the male members 70 and the female members 68 as they are urged together. As the opposed clip members 60 are urged together from a generally axially aligned position as seen in FIG. 16 towards a position in FIG. 17, the frustoconical entry camming surfaces 85 of the head portion 93 of the male member 70 engage with the annular bevelled cam surface 86 of the entry opening 65 of the female member 68 to urge each of the clip members 60 to slide on the support surfaces 51 of their respective bosses 50 into positions in which the male members 70 are coaxially aligned with the female members 68. During assembly of a frame half from a position as shown in FIG. 16 to a position shown in FIG. 17, however, with the frame halves appropriately located relative to window opening 17 as seen in FIG. 3 with the slab 11 and panel 12 appropriately oriented between the frame halves, one frame half may be urged into another frame half as by manually pushing or by applying forces as by reasonable blows as with a manual rubber mallet. The male members 70 enter the female members 68 reducing the distance between the frame halves until the inner clamp surfaces 42 and the other clamp surfaces 43 suitably engage and clamp therebetween the door slab 11 and the window panel 12. The frame halves are to have a particular configuration adapted for use with a particular door slab 11 of a given thickness and a window panel 12 of another given thickness.

Each frame half 20 and 30 is preferably molded as from a relatively rigid material such as fibreglass. While preferably each frame half 20 and 30 are identical, this is not necessary and the frame halves need not be identical. The clip members are preferably injection molded from a material which is substantially rigid yet may have some resiliency. Many suitable plastics and polymers are known to persons skilled in the art. The fastener 80 is shown to be a threaded screw. Many other forms of fasteners such as rivets and the like may be utilized. In accordance with the present invention, the frame halves can be fastened together merely by urging the two frame halves together without the use of any particular tools. As the clip members 60 are retained together in frictional engagement, if necessary, the frame halves may be separated as, for example, by using a screwdriver or other pry bar to force the frame halves apart with sufficient strength to overcome the engagement of the male member 70 within the female member 68.

In the preferred embodiment, the male member carries a plurality of annular catch members 96 and the female member 68 carries a single annular hook member 86. It is to be appreciated that a plurality of such hook members could be provided on the female member 68 and that merely one catch member 96 need be provided on the male member 70.

Referring to FIG. 19, section line D-D' may be considered to be a longitudinal plane which includes the axis 82 of the female member, the axis 91 of the male member, and an axis 126 through the opening 72. This longitudinal plane includes the longitudinal axis Y-Y' of the clip member 60 and the longitudinal Z-Z' of each frame member and its respective boss 50. FIG. 20 is effectively a cross-sectional view along this longitudinal plane of the frame members. Each of the first clamp surfaces 42 and the second clamp surfaces 43 are disposed in planes which are perpendicular to the longitudinal plane of each frame member. Each locating boss 50 is located longitudinally aligned and centered on the longitudinal plane with each locating boss 50 directionally oriented longitudinally of each frame member within the longitudinal plane. Each locating surface 51 is disposed in a plane which is normal to the longitudinal plane.

While the invention has been described with reference to preferred embodiments, many modifications and variations will now occur to persons skilled in the art. For a definition of the invention, reference is made to the following claims.

We claim:

1. A window frame comprising:

a first frame half comprising an elongate first frame member, a second frame half comprising an elongate second frame member, each frame member having an inner surface and an outer surface, each frame member having an elongate inwardly directed first clamp surface extending along a first lateral edge of the inner surface adapted for engagement with a first panel and an elongate inwardly directed second clamp surface extending along a second lateral edge of the inner surface adapted for engagement with a second panel, the frame members removable coupled together with:

(a) the inner surfaces in opposition to each other, (b) the inner clamp surface of each frame member spaced a first distance apart from the inner clamp surface of the other frame member and extending parallel to the inner clamp surface of the other frame member, and (c) the outer clamp surface of each frame member spaced a second distance apart from the outer clamp surface of the other frame member and extending parallel to the outer clamp surface of the other frame member, each of the first frame half and the second frame half having on their inner surfaces a plurality of identical locating bosses, the bosses evenly spaced longitudinally along the frame members, each locating boss carrying a keying member, a plurality of identical modular clip members, each clip member having an inner surface and an outer surface, the outer surface of the clip member including a key member complementary to the keying member, each clip member fixedly secured to a respective one of the locating bosses with the keying member engaging the key member to locate the clip member in an orientated position, the outer surface of each clip member carrying a female socket member and a male post member, the first frame member secured to the second frame member by each clip member on each locating boss on the first frame member being coupled to a respective clip member secured to a locating boss on the second frame member to form a paired connection in which the outer surface of each clip member of each paired connection in is opposition to the outer surface of each other clip member of each paired connection with the male post member of each clip member of each paired connection frictionally received in frictional engagement in the female socket member of each other clip member of each paired connection.

2. A window frame as claimed in claim 1 wherein:

each locating boss having a blind bore opening inwardly away from the inner surface about a bore axis, an opening through each clip member from the inner surface to the outer surface, wherein when each clip member is in the orientated position on each respective locating boss, the circular opening is coaxially aligned with the blind bore, and a fastener extending outwardly through the opening in each clip member into the aligned bore to secure each clip member to its respective boss in the orientated position against relative movement.

3. A window frame as claimed in claim 1 wherein a first of each female socket member and each male post member carries a plurality of annular catch members spaced axially there along for engagement with at least one annular hook member on a second, other of each female socket member and each male post member, whereby each male post member frictionally engages within each respective female socket member in a ratcheting manner against removal at different spacings of the frame members from each other.

4. A window frame as claimed in claim 1 wherein the second frame half being identical to the first frame half.

5. A window frame as claimed in claim 2 wherein the female socket member has an internal socket extending from the clip member about a socket axis to an entry opening at a distal end, the male post member extends from the clip member about a post axis parallel to the socket axis.

6. A window frame as claimed in claim 5 wherein when a clip member is fixedly secured to a respective locating boss, the socket axis and the post axis are located in a common flat longitudinal plane extending longitudinally of the frame member carrying the boss, and the inner clamp surface is disposed in a plane normal to the longitudinal plane.

7. A window frame as claimed in claim 6 wherein each boss has an inner support surface disposed in a plane normal to the longitudinal plane, the outer surface of the clip member includes a flat portion for mating engagement with the inner support surface, the flat portion of the outer surface of the clip member is in a flat plane normal to the socket axis.

8. A window frame as claimed in claim 1 wherein each boss has an inner support surface disposed in a plane normal to inner clamp surface, the outer surface of the clip member includes a flat portion for mating engagement with the inner support surface.

9. A window frame as claimed in claim 1 wherein the key member comprises a key recess extending into the clip member from the outer surface, the keying member comprises a locating lug slidably received in the key recess.

10. A window frame as claimed in claim 9 wherein the locating lug includes a pair of laterally spaced parallel planar side walls extending longitudinally of the frame member carrying the lug member, the key recess having a pair of laterally spaced parallel planar side walls for engagement with the side walls of the lug member to align the clip member longitudinally with the frame member carrying the locating lug.

11. A window frame as claimed in claim 6 wherein the key member comprises a key recess extending into the clip member from the outer surface, the keying member comprises a locating lug slidably received in the key recess.

12. A window frame as claimed in claim 11 wherein the locating lug includes a pair of laterally spaced parallel planar side walls extending parallel to the longitudinal plane, the key recess having a pair of laterally spaced parallel planar side walls for engagement with the side walls of the lug member to align the clip member with the socket axis and the post axis located in the longitudinal plane.

13. A window frame as claimed in claim 12 wherein a bore axis is parallel to the socket axis and lies in the longitudinal plane.

14. A window frame as claimed in claim 12 wherein the opening is provided on the clip member between the female socket member and the male post member.

15. A window frame as claimed in claim 2 wherein the opening is provided on the clip member between the female socket member and the male post member.

16. A window frame as claimed in claim 2 wherein the male post member extends from the clip member to a distal head portion which carries a camming centering surface which extends axially outwardly as it extends radially inwardly, during insertion of the male post member into the socket, the centering surface of the male post member engaging annular surfaces of the entry opening to cam the male post member and socket into coaxial alignment.

17. A window frame comprising:

a first frame half comprising an elongate first frame member, a second frame half comprising an elongate second frame member, each frame member having an inner surface and an outer surface, each frame member having an elongate inwardly directed first clamp surface extending along a first lateral edge of the inner surface adapted for engagement with a first panel and an elongate inwardly directed second clamp surface extending along a second lateral edge of the inner surface adapted for engagement with a second panel, each of the first frame half and the second frame half having on their inner surfaces a plurality of identical locating bosses, the bosses evenly spaced longitudinally along the frame members, each locating boss carrying a keying member, a plurality of identical modular clip members, each clip member having an inner surface and an outer surface, the outer surface of the clip member including a key member complementary to the keying member, each clip member fixedly secured to a respective one of the locating bosses with the keying member engaging the key member to locate the clip member in an orientated position, the outer surface of each clip member carrying a female socket member and a male post member, the first frame member secured to the second frame member by each clip member on each locating boss on the first frame member being coupled to a respective clip member secured to a locating boss on the second frame member to form a paired connection in which the outer surface of each clip member of each paired connection in is opposition to the outer surface of each other clip member of each paired connection with the male post member of each clip member of each paired connection frictionally received in frictional engagement in the female socket member of each other clip member of each paired connection.

18. A window frame as claimed in claim 17 wherein the female socket member has an internal socket extending from the clip member about a socket axis to an entry opening at a distal end, the male post member extends from the clip member about a post axis parallel to the socket axis, wherein when a clip member is fixedly secured to a respective locating boss, the socket axis and the post axis are located in a common flat longitudinal plane extending longitudinally of the frame member carrying the boss, and the inner clamp surface is disposed in a plane normal to the longitudinal plane.

19. A window frame as claimed in claim 18 wherein each boss has an inner support surface disposed in a plane normal to the longitudinal plane, the outer surface of the clip member includes a flat portion for mating engagement with the inner support surface, the flat portion of the outer surface of the clip member is in a flat plane normal to the socket axis.

* * * * *